United States Patent [19]

Raisin et al.

[11] 4,020,655

[45] May 3, 1977

[54] DEVICE FOR DETECTING DEFECTS IN NEEDLES ON A KNITTING LOOM WHICH IS IN OPERATION

[75] Inventors: Jean-Pierre Raisin, Troyes; Bernard Helffer, Saint Andre les Vergers, both of France

[73] Assignee: Centre Technique Industriel dit: Institut Textile de France, Boulogne sur Seine, France

[22] Filed: Jan. 20, 1976

[21] Appl. No.: 650,693

[30] Foreign Application Priority Data

Jan. 22, 1975 France ..... 75.01987

[52] U.S. Cl. ..... 66/157

[51] Int. Cl.[2] ..... D04B 35/18

[58] Field of Search ..... 66/157, 165, 163; 200/61.42; 324/37, 41, 82; 340/259, 267, 282

[56] References Cited

UNITED STATES PATENTS

| | | | |
|---|---|---|---|
| 3,509,739 | 5/1970 | Gottschall | 66/157 |
| 3,529,444 | 9/1970 | Romoli | 66/157 |
| 3,646,542 | 2/1972 | Anthony | 66/157 X |
| 3,851,323 | 11/1974 | Eltgen | 66/157 X |
| 3,905,211 | 9/1975 | Raisin et al. | 66/157 |
| 3,906,752 | 9/1975 | Eichhorst | 66/157 |
| 3,910,074 | 10/1975 | Parker | 66/157 |

*Primary Examiner*—Louis K. Rimrodt
*Attorney, Agent, or Firm*—Lewis H. Eslinger

[57] ABSTRACT

A device is disclosed for detecting defects in needles on a knitting loom which is operating. The device comprises at least one Hall probe magnetic detector the active surface of which has a width less than the thickness of the needles to be detected. The detector is mounted such that the needles all pass successively in front of it during their working movement, and an electronic circuit transforms the signals received from the magnetic detector into a signal for controlling the stoppage of said loom. The electronic circuit comprises first and second electronic circuits each of which is adapted to supply a signal for controlling the stoppage of the loom.

6 Claims, 5 Drawing Figures

DEVICE FOR DETECTING DEFECTS IN NEEDLES ON A KNITTING LOOM WHICH IS IN OPERATION

The present invention relates to a device for detecting defects in the needles of a knitting machine whilst it is operating, comprising at least one magnetic detector mounted such that the needles all pass successively in front thereof during their working movement and an associated electronic circuit able to transform the signals received from said magnetic detector and corresponding to the detection of a defect in a needle into a signal for controlling the stoppage of said loom, said magnetic detector being constituted by at least one Hall probe and the active surface of this probe having a width less than the thickness of the needles to be detected. Such a device is described in our U.S. Pat. No. 3,905,211, issued Sept. 16, 1975.

The passage of the needles in front of the magnetic detector gives rise to a succession of output signals from the detector of pseudo-sinusoidal appearance. When a needle comprises a defect characterised by an abnormal modification of its structure, the corresponding signal transmitted by the detector has either an amplitude greater than normal, or a zero amplitude or amplitude less than normal.

The electronic circuit described in the aforementioned U.S. Patent comprises a first and second electronic circuit, intended to send a control signal in the form of a pulse to a member for controlling the stoppage of the loom in response to a signal whose amplitude is greater than normal and to a signal whose amplitude is zero or less than normal respectively. The first electronic circuit comprises a first comparator which supplies a fault pulse when the amplitude of a signal transmitted by the detector exceeds a predetermined value. The second electronic circuit comprises a second comparator which transforms the signals transmitted by the magnetic detector into a succession of pulses of the same frequency as these signals, by detecting the passage through zero of these signals and the appearance of a signal whose amplitude is zero or less than normal, such a signal not passing through zero, is translated as a missing pulse, which is then converted into a fault pulse.

It has been found that this electronic circuit detects defects in the needles in a satisfactory manner, but also causes unnecessary stoppages of the loom, i.e. it produces fault pulses in the absence of defects in the needles. It has been found that these unnecessary stoppages were due mainly to signals transmitted by the detector and having an appreciable amplitude variation, but not passing through zero, these signals being representative not of a defect in a needle, but of a trajectory of this needle, as it passes in front of the detector, which trajectory is offset with respect to the normal. Since such an offset trajectory is not detrimental to satisfactory operation of the loom, it is desirable to prevent signals of this type from being converted into fault pulses.

It is an object of the present invention to provide a device which does not produce a fault pulse as the result of a needle having a trajectory which is offset to the normal but not operating unsatisfactorily.

According to the present invention, there is provided a device for detecting defects in needles on a knitting loom which is operating, comprising at least one magnetic detector mounted such that the needles all pass successively in front thereof during their working movement and an associated electronic circuit able to transform the signals received from said magnetic detector and corresponding to the detection of the fault in a needle into a signal for controlling the stoppage of said loom, said magnetic detector being constituted by at least one Hall probe and the active surface of this probe having a width less than the thickness of the needles to be detected, characterised in that the electronic circuit comprises a first and a second electronic circuit, each connected to the magnetic detector, the first electronic circuit comprising a first comparator able to detect a signal whose amplitude is greater than a predetermined value and to supply a signal for controlling the stoppage of the loom in response to this detection, the second electronic circuit comprising a differentiation circuit, a shaper circuit comprising a second comparator circuit and able to transform the signals coming from the differentiation circuit into a sequence of pulses whose recurrence frequency is equal to that of these signals, and a detector circuit able to detect a missing pulse in the signal coming from the shaper circuit and to supply a signal for controlling the stoppage of the loom in response to this detection.

Differentiation of the signals transmitted by the magnetic detector makes it possible to transform the signals not passing through zero, but having an appreciable amplitude variation, into signals passing through zero and thus to prevent such signals from giving rise to a fault pulse.

Preferably, the signals transmitted by the detector will be filtered before being differentiated in order to eliminate parasite signals whose frequency is greater than the frequency of the pseudo-sinusoidal signals produced by the needles.

The shaper circuit located downstream of the differentiation circuit may be either a device for detecting a passage through zero, or a Schmitt trigger symmetrical with respect to zero. The shaper circuit may also be advantageously formed by a peak detector circuit able to convert the signals coming from the differentiation circuit into a sequence of pulses when the variation of these signals between two adjacent peaks is greater than a predetermined threshold. This configuration of the second comparator circuit makes it possible to prevent the generation of a fault pulse when the curve representative of the signal transmitted by the magnetic detector has an inflection point, the derived signal thus generally not passing through zero. In fact, the magnetic detector is able to transmit such a signal when two needles which are very close to each other pass in front of the latter, which is not necessarily detrimental to the satisfactory operation of the loom.

Further features and advantages of the present invention will become apparent from the description given hereafter, as a non-limiting example and referring to the figures of the accompanying drawings in which.

Figure 3:
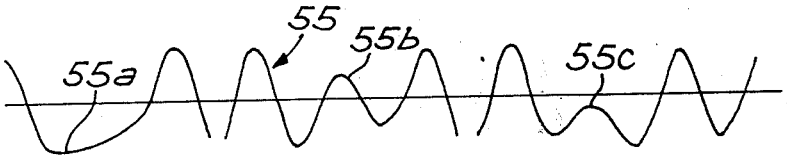

The magnetic detector shown diagrammatically in FIG. 3 is similar to that described in the aforementioned U.S. Patent and comprises two Hall probes 7, mounted as a half-bridge arrangement. Each probe 7 is connected at one end at 10 to a source of voltage which is not shown and at the other end is earthed at 9 through a resistance 8. The signals transmitted by the magnetic detector are sent to the input of a low pass filter 50 whose cut-off frequency is determined in dependence on the speed of the loom, this speed corresponding to the frequency of passage of the needles and thus to the frequency of the pseudo-sinusoidal signals resulting from the detection of the passage of these needles.

The signals coming from the filter 50 are sent to the input 14*a* of a comparator 14 whose other input 14*b* is connected to an adjustable voltage source 17. At its output 14*c*, this comparator 14 produces a fault pulse when a signal whose amplitude is greater than the voltage of the source 17 appears at the input 14*a*. This fault pulse constitutes a signal for controlling the stoppage of the loom and is sent to the input 19*a* of an "OR" circuit 19, whose output 19*c* is connected to a member which is not shown, for controlling the stoppage of the loom.

The signals coming from the filter 50 are also sent to the input 52*a* of a differentiation circuit 52 whose output 52*b* is connected to the input 53*a* of a shaper circuit 53. The shaper circuit 53 may consist of a comparator circuit 21, transforming the signals coming from the differentiation circuit 52 into a sequence of pulses whose recurrence frequency is equal to the frequency of these signals. The output 53*b* of the shaper circuit 53 is connected to a monostable circuit 22 serving to calibrate the pulses supplied by the shaper circuit. The output of the monostable circuit 22 is connected to a retriggerable monostable circuit 23 which detects the absence of a pulse in a signal coming from the monostable circuit 22 and thus from the shaper circuit 53. This retriggerable monostable circuit 23 operates as described in the aforementioned U.S. Patent and its triggering time is governed firstly by the period of the pulses coming from the monostable circuit 22 by means of a control member 32 and secondly may be regulated by means of the circuit formed by the capacitor 30 and adjustable resistance 31. In response to the detection of a missing pulse, the retriggerable monostable circuit 23 supplies a fault pulse at its output connected to the input 19*b* of the "OR" circuit 19, this fault pulse constituting a signal for controlling the stoppage of the loom.

Figure 2:
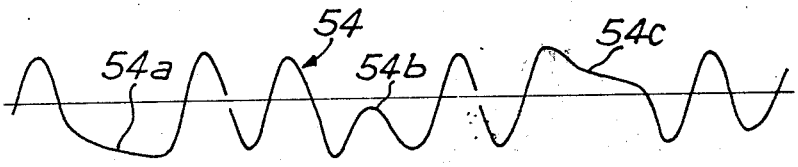
FIGS. 2 and 3 show the variation curves of the signals transmitted by the magnetic detector and the derivatives of these signals respectively.
Figure 4:
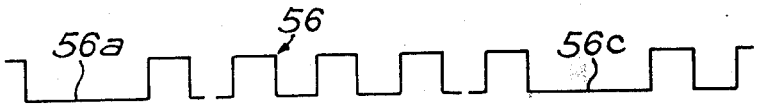
FIG. 4 shows the variation curves of the signals transmitted by the shaper circuit of the device of FIG. 1, in response to the signal of FIG. 2 transmitted by the magnetic detector.

The curves in FIGS. 2, 3 and 4 illustrate respectively a succession of signals 54 transmitted by the magnetic detector, the corresponding signals 55 at the output 52*b* of the differentiation circuit 52 and the corresponding signals 56 at the output 53*b* of the shaper circuit 53. It will be noted that corresponding to the absence of a signal 54*a* is the absence of a signal 55*a* and the absence of a pulse 56*a*, which missing pulse will give rise to a fault pulse. On the other hand, a signal 55*b* passing through zero, which does not give rise to a missing pulse corresponds to a signal such as 54*b*, having an appreciable amplitude variation, but not passing through zero. Nevertheless, it may happen that a signal transmitted by the magnetic detector has an inflection point as at 54*c*. Such a signal is due to the passage of two very close needles, which would not necessarily cause a visible fault on the article produced. The signal 55*c* corresponding to the signal 54*c* has an alternation not passing through zero and will therefore give rise to the absence of a pulse at 56*c*. Also, advantageously, the shaper circuit 53 will be formed as a peak detector having a threshold, able to convert the signals sent thereto into a succession of pulses of recurrence frequency equal to that of these signals when these signals have an amplitude variation between two successive peaks greater than a predetermined threshold. The peak of a signal is intended to mean a point of the curve representative of the signal where the derivative of this signal passes through zero and changes its sign. The use of such a peak detector circuit having a threshold will therefore make it possible not to produce a fault pulse in response to a signal such as 54*c*.

Figure 1:
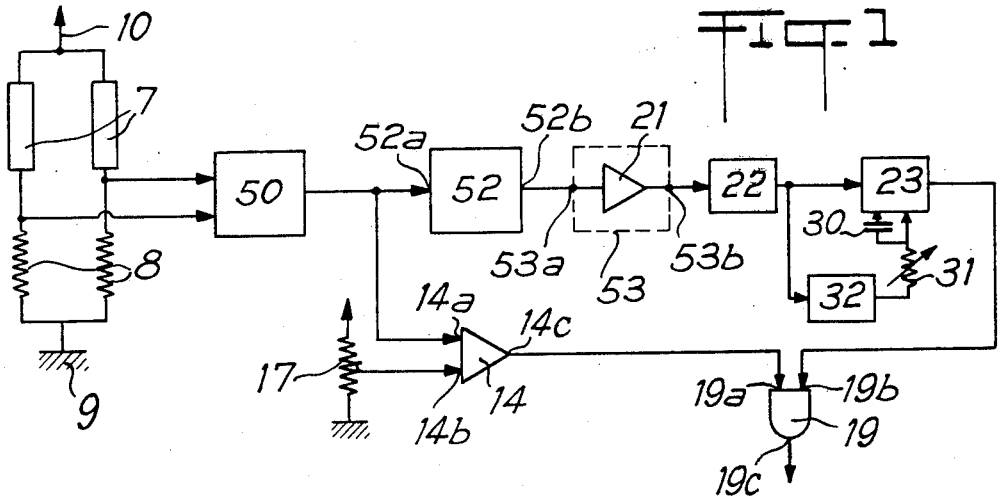
FIG. 1 is a diagrammatic illustration of a device according to the present invention.
Figure 5:
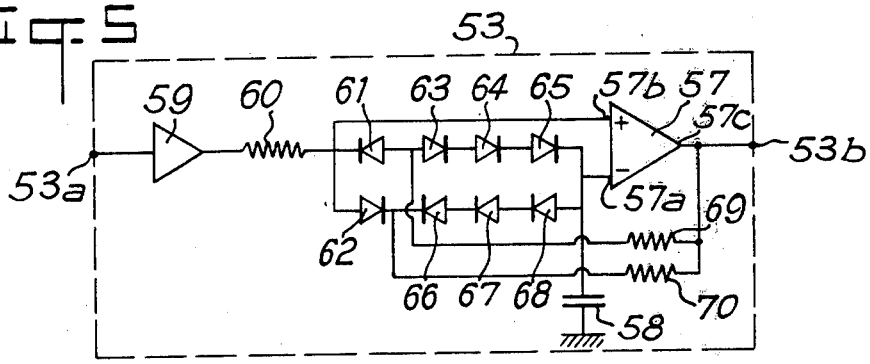
FIG. 5 is a diagrammatic illustration of a second embodiment of the second comparator circuit of the device shown in FIG. 1.

FIG. 5 shows one embodiment of the shaper circuit 53 in the form of a peak detector having a threshold of the type described in French Pat. No. 2,272,396. This detector comprises a comparator 57 whereof one input 57*a* is earthed by means of a capacitor 58. The signals reaching the input 53*a* are sent to the other input 57*b* of the comparator 57 by means of an amplifier 59 and resistance 60. The comparator 57 is in the form of a high gain amplifier.

The input 57*b* of the comparator 57 is connected firstly to the cathode of a diode 61 and secondly to the anode of a diode 62, the anode of the diode 61 being connected to the input 57*a* by the intermediary of anode-cathode junctions of three diodes 63, 64, and 65, connected in series and the cathode of the diode 62 being connected to the input 57*a* by means of a cathode-anode junctions of three diodes 66, 67 and 68 also connected in series. Finally, the output 57*c* of the comparator 57 constitutes the output 53*b* of the shaper circuit and is firstly connected to the anode of the diode 61 by a resistance 69 and secondly to the cathode of the diode 62 by a resistance 70.

The operation of this peak detector circuit having a threshold is described in detail in French Patent Application No. 74 18 071 and will be summarised briefly hereafter. When the voltage $v_e$ at the input 57*b* of the comparator 57 increases, the voltage $v_s$ at the output of the comparator is at its saturation value and the capacitor 58 is charged at a voltage $v_c$. Since $v_d$ is the voltage drop at the terminals of any of the diodes 61 to 68, assumed to be identical, the capacitor charges at a voltage $v_c = v_e - 2v_d$. When the signal $v_e$ begins to decrease, the voltage $v_c$ remains constant until the voltage $v_e$ has decreased from a value $2v_d$. From this instant, the voltage $v_s$ changes its sign, the capacitor 58 discharges and its voltage $v_c$ is equal to $v_e + 2v_d$. when the signal $v_e$ once more begins to increase, the voltage $v_c$ remains constant until the voltage $v_e$ has increased from a value $2v_d$ and the voltage $v_s$ thus once more changes its sign. The comparator 57 thus supplies a sequence of pulses, its output voltage changing sign in the gap separating two adjacent peaks of the voltage $v_e$ when the amplitude variation of this voltage $v_e$ in this interval is greater than a threshold equal to $2v_d$. The value of this threshold may be modified by providing a different number of diodes 61 to 68. Also, if one has four diodes in series between the anode of the diode 61 and the input 57*a* and between the cathode of the diode 62 and the input 57*a*, this threshold value will be equal to $3v_d$.

Naturally, various modifications and additions may be applied to the device described above without diverging from the framework of the present invention.

What is claimed is:

1. A device for detecting defects in needles on a knitting loom which is operating, comprising at least one magnetic detector mounted such that the needles all pass successively in front thereof during their working movement, said magnetic detector being constituted by at least one Hall probe having an active surface of a width less than the thickness of the needles to be detected, a first electronic circuit connected to the magnetic detector and including a first comparator for detecting signals produced by said magnetic detector whose amplitude is greater than a predetermined value and to provide a first control signal for stopping the loom in response to this detection, and a second electronic circuit comprising a differentiation circuit connected to said magnetic detector for differentiating the signals produced by said magnetic detector, a shaper circuit coupled to said differentiation circuit for converting the differentiated signals into a sequence of pulses whose recurrence frequency is equal to that of said differentiated signals, and a detector circuit for detecting a missing pulse in the signal supplied by said shaper circuit to provide a second control signal for stopping said loom.

2. A device according to claim 1, wherein said shaper circuit is a peak detector circuit having a threshold level, the peak detector circuit converting the differentiated signals produced by said differentiation circuit into a sequence of pulses when the amplitude of said differentiated signals varies between two adjacent peaks by an amount greater than said threshold.

3. A device according to claim 2, wherein said peak detector circuit comprises a second comparator circuit, a capacitor connected to a first input of the second comparator circuit whose second input is connected to the output of the differentiation circuit, and means for charging said capacitor when said differentiated signal applied to said second input of said second comparator circuit increases from a point greater than said threshold at which its derivative is zero, and for discharging said capacitor when said differentiated signal decreases from a point greater than said threshold at which its derivative is zero.

4. A device according to claim 1, wherein the first and second electronic circuits are connected to the magnetic detector by a low pass filter.

5. A device according to claim 1, wherein said shaper circuit includes means for detecting the passage of a signal through zero level.

6. A device according to claim 1, wherein said shaper circuit is a Schmitt trigger having triggering levels symmetrical with respect to zero.

* * * * *